United States Patent [19]

Dupont

[11] 4,226,617

[45] Oct. 7, 1980

[54] METHOD FOR TREATING A MINERAL SULFIDE

[75] Inventor: Jacques J. M. J. A. G. Dupont, Brussels, Belgium

[73] Assignee: Nichols Engineering Societe Anonyme, Brussels, Belgium

[21] Appl. No.: 615,910

[22] Filed: Sep. 23, 1975

[30] Foreign Application Priority Data

Sep. 26, 1974 [BE] Belgium ..... 148915

[51] Int. Cl.[3] ..... C22B 1/02

[52] U.S. Cl. ..... 75/7; 423/47; 423/110; 423/153; 423/154

[58] Field of Search ..... 75/1, 3, 4, 5, 6, 7, 75/8, 9, 21, 72, 86; 423/47, 110, 153, 154, 571, 542

[56] References Cited

U.S. PATENT DOCUMENTS

| | | | |
|---|---|---|---|
| 2,209,331 | 6/1940 | Haglund | 423/47 |
| 2,719,082 | 9/1955 | Sproube et al. | 75/7 |

FOREIGN PATENT DOCUMENTS

| | | | |
|---|---|---|---|
| 6197 | 3/1927 | Australia | 75/7 |
| 548122 | 11/1956 | Belgium | 75/7 |
| 751167 | 5/1958 | Canada | 75/9 |

OTHER PUBLICATIONS

Weast, R. C., Ed.; *Handbook of Chemistry and Physics,* The Chemical Rubber Co., Cleveland, Ohio, 52nd edition (1971) pp. B62, 89, 99, 114.

*Primary Examiner*—L. Dewayne Rutledge
*Assistant Examiner*—Michael L. Lewis
*Attorney, Agent, or Firm*—Fitzpatrick, Cella, Harper & Scinto

[57] ABSTRACT

This invention relates to method and apparatus for treating a sulfur containing material having at least one principal sulfide either in the form of a sulfide or in a form that is transformable into a sulfide and at least one auxiliary sulfide more volatile than the principal sulfide or transformable into another sulfide more volatile than the principal sulfide, wherein the sulfurous material is heated in one furnace zone, having a non-oxidizing atmosphere in the gas phase, to a temperature between that required for volatilization of the principal sulfide and that required for volatilization of the auxiliary sulfide to volatilize the auxiliary sulfide and labile sulfur, without volatilizing or substantially oxidizing the principal sulfide; and heating the sulfurous material in another furnace zone, having an oxidizing atmosphere in the gas phase, to a temperature lower than that required for substantial oxidization of the principal sulfide, to oxidize the volatilized labile sulfur and auxiliary sulfide, without substantially oxidixing the principal sulfide.

15 Claims, 2 Drawing Figures

Figure 1:
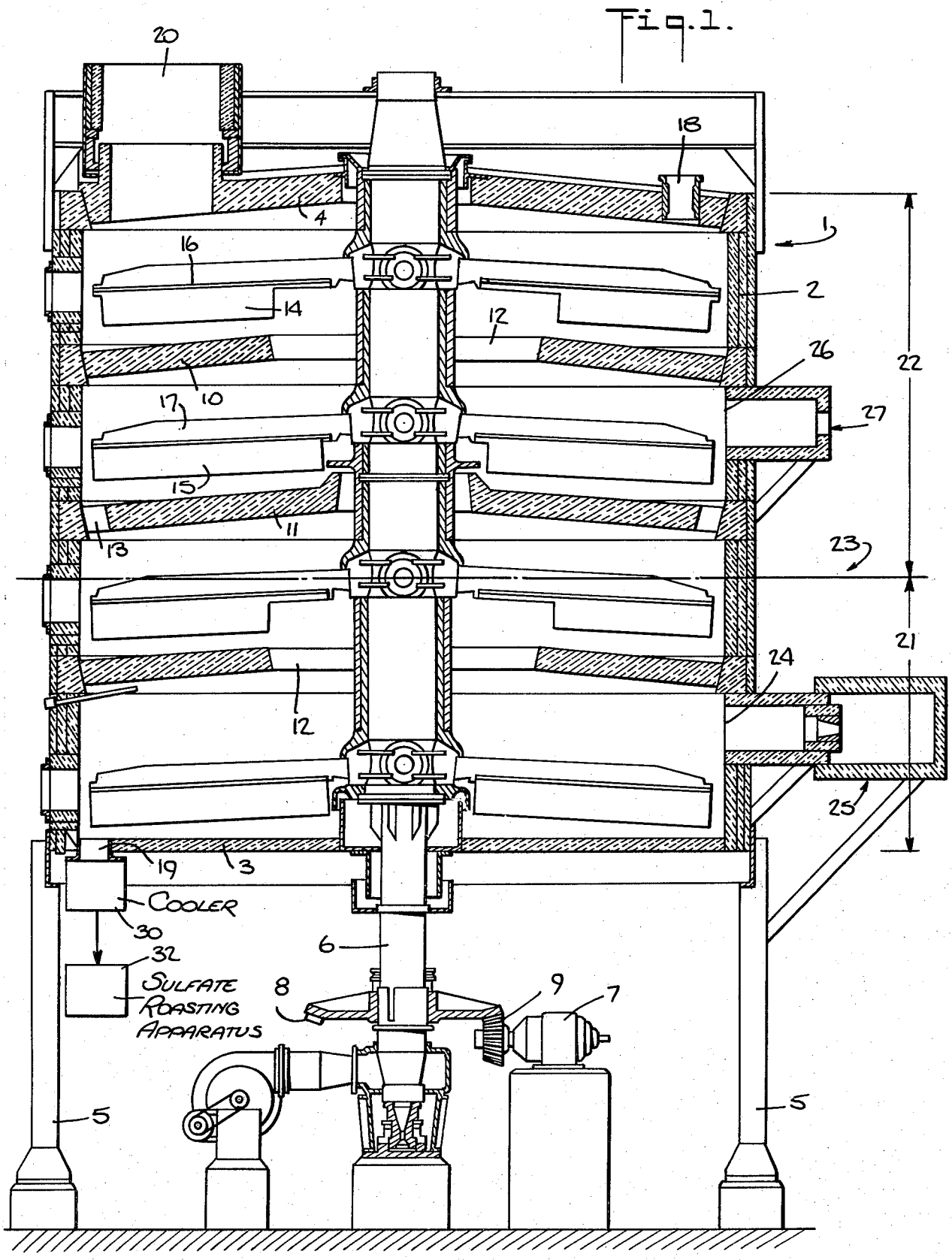

20
18
4
1
16
2
14
12
26
22
10
17
27
15
11
13
23
21
24
12
25
19
3
COOLER
30
32
6
SULFATE
ROASTING
APPARATUS
8
9
7
5
5

ZONE 22
ZONE 21
800°C
600°C
TEMPERATURE °C.
29
28
1

METHOD FOR TREATING A MINERAL SULFIDE

This invention relates to a process for the treatment of a mineral compound, or compounds, containing at least one principal metal and at least one auxiliary metal, either in the form of sulfides or in forms that are transformable into sulfides. In particular, for example, this invention relates to a method and apparatus for treating a sulfur containing material having at least one principal sulfide either in the form of a sulfide or in a form that is transformable into a sulfide and at least one auxiliary sulfide more volatile than the principal sulfide or transformable into another sulfide more volatile than the principal sulfide.

More particularly, for example, the process pursuant to the invention is applicable to the treatment of pyrite constituted essentially of iron disulfide, convertible by heating into iron sulfide, and of an auxiliary sulfide, such as arsenic sulfide or mispickel, convertible into arsenic sulfide, which is more volatile than the iron sulfide.

The present invention is of particularly special interest when the ore contains elements that are important to recover and that are impossible to separate first by mechanical operation.

In particular, pyrites contain non-ferrous metals such as copper, zinc, etc., which are so intimately mixed mineralogically with the iron disulfide that it is not possible to extract them economically by flotation. Also, pyrites often contain arsenic, antimony, bismuth or other metals that would, upon roasting the mixtures thereof to sulfates or oxides or the combination of both, make the copper and zinc less than completely available to a leach liquor.

The invention is applicable to granulated pyrites, as well as to floated pyrites derived from the flotation of mixed non-ferrous ores. Heretofore, granulated or floated pyrites have been used for the manufacture of sulphuric acid and the sulfur was extracted from them by an oxidation roasting process. In addition, in some instances, if one also wanted to recover copper, zinc, etc., he employed a double roasting process including a reduction step and an oxidizing step. Recovery of the non-ferrous metals was also effected after the oxidation roasting process by a subsequent chlorination roasting process. The chlorination roasting operation required major plant equipment involving a considerable investment. Further, known chlorination roasting processes were not very profitable because of the sizable power consumption, as well as the cost of handling and transporting the ore between the oxidation roasters of the various sulfuric acid manufacturing units and the chlorination roasters of the central non-ferrous metals recovery plant.

Further, it is known to treat other sulfurous ores by processes similar to those used for pyrite.

The present invention makes it possible to establish conditions during the initial phase of the treatment of the sulfurous ore to facilitate the recovery of the non-ferrous elements, while at the same time, ensuring extraction of the sulfur in the form of sulfurous anhydride for the manufacture of sulfuric acid.

An object of the invention is the provision of a new process for the treatment of the sulfurous ore of the type described above, such as pyrite, for example, which is especially economical both with respect to the initial investment cost of the installation, as well as the subsequent operating costs. In particular, fuel consumption is distinctly lower in my new process than in the known processes. In addition, the new process makes it possible to treat either floated or granulated ores.

To this end, pursuant to my new process, the sulfide ore is heated:

in one furnace zone, having a non-oxidizing atmosphere in the gas phase, to a temperature between the points of volatilization of the principal and auxiliary sulfides, to volatilize the unvolatilized auxiliary sulfide and labile sulfur, without volatilizing the principal sulfide and without substantially oxidizing the principal sulfide;

and in another furnace zone, having an oxidizing atmosphere in the gas phase, to a temperature below the temperature at which the rate of oxidation of the principal sulfide becomes substantial, but at a temperature high enough to oxidize the volatilized labile sulfur and auxiliary sulfide which are in the gas phase, without substantially oxidizing the principal sulfide.

In particular, for example, for pyrite, the pyrite is heated in one furnace zone, having a non-oxidizing atmosphere in the gas phase, to a temperature of between about 400° C. and about 1,000° C. to volatilize the arsenic sulfide and the labile sulfur, without volatilizing the iron sulfide and without substantially oxidizing the iron sulfide; and in another furnace zone, having an oxidizing atmosphere in the gas phase, the pyrite is heated to a temperature below about 425° C. to oxidize the volatilized labile sulfur and arsenic sulfide, without substantially oxidizing the iron sulfide.

More particularly, for example, pursuant to the new process, the sulfurous ore, such as pyrite for example, is heated in the furnace zone having a non-oxidizing atmosphere in the gas phase, by a stream of hot neutral or reducing gases. The term neutral gases is intended to include such species as $SO_2$, or even limited quantities of air, or other gases, as long as the atmosphere in this furnace zone is maintained substantially non-oxidizing with respect to the principal sulfide. In the other furnace zone, having an oxidizing atmosphere in the gas phase, the sulfurous ore is heated by hot gases from the reducing furnace zone and by the combustion of the labile sulfur and the auxiliary sulfide, such as the arsenic sulfide for example, by a stream of air or other oxygen source, which may be preheated.

In one form of my invention, the sulfurous ore, such as the pyrite for example, is heated in a single multiple hearth furnace. Heating is effected by admitting a stream of hot neutral or reducing gases into the lower zone of the furnace where the non-oxidizing atmosphere in the gas phase prevails. Heating in the upper zone of the furnace is effected by the stream of hot gases flowing from the lower zone and by the aforementioned combustion due to the stream of air injected into the upper zone of the furnace, where the oxidizing atmosphere in the gas phase prevails. Thus, the sulfurous ore, such as the pyrite for example, and the stream of hot gases including the air, move in counter-current flow, with respect to each other, in the furnace.

In order to make the material treated, such as the pyrite for example, friable and porous, to easily recover the non-ferrous metals and to continuously feed the treated material to subsequent treatment processes, provision is made for abruptly cooling the material as it comes out of the lower zone of the furnace. Preferably, the so-processed sulfurous ore, such as the pyrite, is cooled by immersion in water, i.e. water quenched.

According to one aspect of my invention, the water quenched material is further processed by subjecting it to a well-known sulfate roasting process.

There has thus been outlined rather broadly the more important features of the invention in order that the detailed description thereof that follows may be understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other methods and apparatus for carrying out the purposes of the invention. It is important, therefore, that this disclosure be regarded as including such equivalent methods and apparatus as do not depart from the spirit and scope of the invention.

Figure 2:
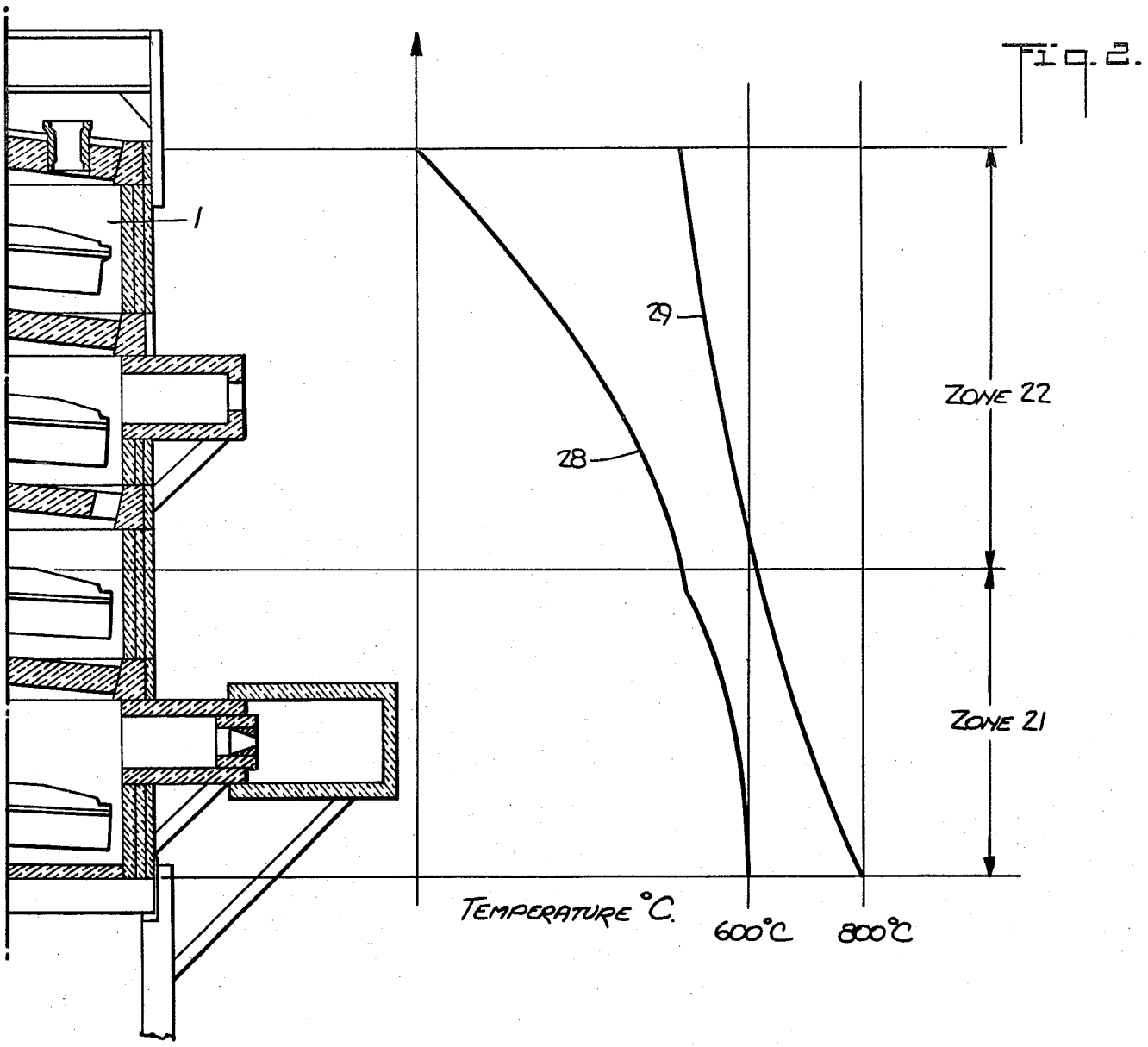

Several embodiments of the invention have been chosen for purposes of illustration and description, and are shown in the accompanying drawings forming a part of the specification, wherein:

FIG. 1 is an elevational view showing somewhat schematically an arrangement of a furnace apparatus for carrying out the invention; and FIG. 2 is a schematic drawing, which shows certain thermal and physico-chemical characteristics of the process of the invention.

As illustrated in FIG. 1, there is provided a multiple hearth furnace 1, mounted on supporting members 5 and having a cylindrical shell 2, of sheet steel or the like, lined with a refractory material, and including a bottom member 3 and a cover 4. The furnace includes a series of vertically spaced hearths 10 and 11, having alternately disposed central and peripheral openings therethrough, as at 12 and 13, respectively. A central shaft 6 extends through the vertical axis of the furnace, and is rotatably driven by an electric motor 7 through gear means 8 and 9. Carried by the shaft 6 are radially extending arms 16, 17, equipped with rabble teeth or rakes, as at 14, 15, the teeth of which are spaced slightly above the hearths to periodically agitate and gradually advance the material over each hearth.

In operation, the sulfurous ore to be treated, such as pyrite for example, passes from the top to the bottom of the furnace 1. The pyrite is introduced into the furnace 1 at an inlet 18 in the cover 4. The pyrite falls onto hearth 10 where it is progressively rabbled by the rabble teeth 14 toward the center shaft where it falls from the inner drop hole 12 to the hearth 11. The pyrite is progressively displaced over the hearth 11 by the rabble teeth 15 toward the outer drop hole 13. The pyrite is thus moved from one hearth to the next until it reaches the bottom 3 where it is conducted to an outlet 19, where it is removed from the furnace 1. The gases are circulated counter-current to the flow of the pyrite and exit from the furnace 1 through an outlet 20.

The furnace 1 is shown theoretically as comprising two zones 21 and 22, separated by an imaginary line 23. In the lower furnace zone 21, which is maintained in a non-oxidizing atmosphere in the gas phase, the pyrite is heated in such a manner as to maintain a temperature between the lowest volatilization temperature of the auxiliary sulfide, such as arsenic sulfide, for example, i.e. about 400° C. and the point of volatilization of the iron sulfide and of any other secondary stable sulfides, i.e. about 1000° C. To this end, a stream of hot neutral or reducing gases are injected into the lower furnace zone 21, through an entrance port 24 from a combustion chamber 25. The labile sulfur and the auxiliary sulfides are separated from the pyrite and volatilized in the lower furnace zone 21. It will be appreciated that the neutral gases may include such species as $SO_2$, or even a limited quantity of air or other gas, as long as the atmosphere in this furnace zone is maintained substantially non-oxidizing with respect to the principal sulfide.

In the upper zone 22, where an oxidizing atmosphere in the gas phase prevails, the pyrite is heated to a temperature lower than that required to substantially oxidize the principal iron sulfide, i.e. about 425° C. or of any other secondary stable sulfides, which may eventuate. For this purpose, a stream of air is injected into the upper furnace zone 22 through a conduit 26 from a supply chamber 27. The air used may be cold or it may be preheated in the supply chamber 27. Thus, the labile sulfur and the auxiliary sulfides, which were volatilized in the lower zone 21, are oxidized in the upper furnace zone 22 without, however, the stable auxiliary sulfides themselves being oxidized. It is to be noted that oxidation of the labile sulfur and of the auxiliary sulfides produces an exothermic effect, thereby heating the pyrite and limiting the consumption of fuel required to produce the stream of hot gases mentioned previously.

The process is now explained with the aid of an example of the treatment of a pyrite having the following composition:

Total Sulfur: 48%
Iron: 42%
Copper: 1%
Zinc: 2%
Arsenic: 0.4%
Slag (generally quartz): 3 to 5%

During its descent through the upper furnace zone 22 of the furnace 1, the pyrite is heated progressively on the one hand by the hot gases, having already lost a part of their sensible heat, coming from below, and on the other by the oxidation of the labile sulfur and of the auxiliary arsenic sulfide previously volatilized in the lower furnace zone 21. The course of the pyrite temperatures in the upper furnace zone 22 is shown by the curve 28 in the diagram of FIG. 2. The oxidation of the labile sulfur and of the arsenic sulfide conforms to the chemical reactions:

$$S+O_2 \rightarrow SO_2 \uparrow$$

$$As_2S_3+4\tfrac{1}{2}O_2 \rightarrow As_2O_3+3\ SO_2 \uparrow$$

During its descent through the lower zone 21 of the furnace 1, the pyrite is heated further by the non-oxidizing hot gases. The temperature of the pyrite in the lower furnace zone 21 is represented by the same curve 28. The temperature of the gas in the furnace 1 is shown by the curve 29.

In the lower furnace zone 21, the reactions are constituted essentially of the following thermal decompositions and volatilizations:

$$FeS_2 \rightarrow FeS+S \uparrow$$

$$2FeAsS+2S \rightarrow As_2S_2 \uparrow +2FeS$$

$$2CuFeS_2 \rightarrow Cu_2S+FeS+S \uparrow$$

$$As_2S_3 \rightarrow As_2S_3 \uparrow$$

$$As_2S_3 \rightarrow As_2S_2 \uparrow +S \uparrow$$

It is to be noted that the zinc sulfide, ZnS, remains unchanged.

Upon leaving the furnace, the treated pyrite is cooled abruptly by immersion in a water tank 30, FIG. 1. Such water tempering makes the pyrrhotite phase of the pyrite friable, said phase being represented essentially by FeS, which becomes porous and which may be economically crushed for the possible recovery of non-ferrous metals. Such tempering further permits a constant feed to the subsequent pyrite treatment apparatus 32, which consists of a per se known sulfating roasting process.

The sulfating roasting process ensures sulfating of the non-ferrous metals while at the same time taking care to avoid the formation of ferrous or ferric sulfates. In the course of the sulfating roasting process, the pyrrhotite sulfide resulting from the thermal decomposition of the pyrite is reduced to as low as possible a value. After the sulfating roasting process, the ore, which may be crushed, is leached with water to cause the non-ferrous sulfates to go into solution. During leaching, the pH is adjusted to obtain maximum recovery yields of the recoverable elements obtained selectively, for example, by case-hardening and neutralization. Finally, the residue of the leaching step may be floated to obtain concentrates, heavily enriched with non-ferrous metals.

Although certain particular embodiments of the invention are herein disclosed for purposes of explanation, various modifications thereof, after study of this specification, will be apparent to those skilled in the art to which the invention pertains.

What is claimed and desired to be secured by Letters Patent is:

1. A process for treating a sulfur containing material having at least one principal sulfide and at least one auxiliary sulfide including arsenic sulfide more volatile than the principal sulfide, said process comprising the steps of passing said material downwardly through a first furnace zone having an oxidizing atmosphere in the gas phase, said first zone being maintained at a temperature less than about 425° C. to prevent substantial oxidation of the principal sulfide but sufficient to oxidize volatilized auxiliary sulfide and labile sulfur, passing said material from said first furnace zone downwardly into a second furnace zone having a non-oxidizing atmosphere in the gas phase, heating said material in said second furnace zone to a temperature between about 400° C. and 1000° C., lowering the sulfur content of said material by volatilizing the auxiliary sulfide and any labile sulfur in said second furnace zone without volatilizing or substantially oxidizing the principal sulfide, passing the volatilized auxiliary sulfide and labile sulfur formed in said second furnace zone through said first furnace zone in countercurrent flow to that of said material in order to oxidize same and, as a result, heat said material as it passes through said first furnace zone and withdrawing the principal sulfide from said second furnace zone.

2. A process for treating a sulfur containing material according to claim 1, further comprising the step of introducing a stream of hot neutral or reducing gas into said second furnace zone.

3. A process for treating a sulfur containing material according to claim 1, further comprising the step of introducing a stream of air into said first furnace zone.

4. A process for treating a sulfur containing material according to claim 1 wherein both of said furnace zones are disposed in the same multiple hearth furnace.

5. A process for treating a sulfur containing material according to claim 1 wherein said principal sulfide is a member of the group consisting of copper sulfide, zinc sulfide, lead sulfide, and nickel sulfide.

6. A process for treating a sulfur containing material according to claim 1 wherein said auxiliary sulfide further includes a member of the group consisting of bismuth sulfide and antimony sulfide.

7. A process for treating a sulfur containing material according to claim 1 further comprising the step of rapidly cooling the withdrawn sulfurous material from said second furnace zone.

8. A process for treating a sulfur containing material according to claim 7, further comprising the step of subjecting the so-processed cooled sulfurous material to a sulfating roasting process.

9. A process for treating a pyrite ore including therein essentially $FeS_2$ and arsenic sulfide or mispickel which is transformable into arsenic sulfide that is more volatile than FeS, said process comprising the steps of passing said pyrite ore downwardly through a first furnace zone and thence through a second furnace zone, heating said pyrite ore in said second furnace zone having a non-oxidizing atmosphere in the gas phase to a temperature between about 400° C. and about 1000° C. sufficient to thermally decompose $FeS_2$ to FeS and to diminish the sulfur content by volatilizing the arsenic sulfide and the labile sulfur without volatilizing the iron sulfide and without substantially oxidizing the iron sulfide, passing said volatilized products from said second zone upwardly to said first zone, and heating said pyrite ore in said first zone having an oxidizing atmosphere in the gas phase to a temperature lower than about 425° C. to oxidize the volatilized sulfur and arsenic sulfide, without substantially oxidizing the downwardly moving iron sulfide.

10. A process for treating a pyrite ore including therein essentially $FeS_2$, $As_2S_3$, $CuFeS_2$ and ZnS, said process comprising the steps of, progressively passing said pyrite ore from top to base of a multiple hearth furnace by rabbling from hearth to hearth, while maintaining a lower zone of said furnace in a non-oxidizing atmosphere in the gas phase at a temperature between about 400° C., and about 1000° C. sufficient to thermally decompose $FeS_2$ to FeS and to lower the sulfur content by volatilizing to produce S, $As_2S_2$, and $As_2S_3$ without volatilizing the iron sulfide and without any substantial iron oxide formation, passing said volatilized products upwardly into an upper zone of said furnace in countercurrent flow to said pyrite ore, while maintaining said upper zone in an oxidizing atmosphere in the gas phase at a temperature lower than about 425° C. to oxidize said volatilized products to form $S0_2$ and $As_20_3$ without substantially oxidizing the iron sulfide, and withdrawing from the top of the upper zone said $S0_2$, $As_2O_3$ and sublimed material and withdrawing from the bottom of the lower zone the remainder of the material including essentially FeS, $Cu_2S$ and ZnS.

11. A process for treating a pyrite ore according to claim 10, further comprising the step of introducing a stream of hot neutral or reducing gas into said lower zone.

12. The process for treating pyrite ore according to claim 10, further comprising the step of introducing a stream of preheated air into said upper zone.

13. The process for treating pyrite ore according to claim 10, further comprising the step of rapidly cooling said FeS, $Cu_2S$ and ZnS withdrawn from said lower zone.

14. The process for treating pyrite ore according to claim 10, further comprising the step of water quenching said FeS, $Cu_2S$ and ZnS withdrawn from said lower zone.

15. The process for treating pyrite ore according to claim 14, further comprising the step of sulfate roasting said FeS, $Cu_2S$ and ZnS subsequent to said water quenching step.

* * * * *